US005742012A

United States Patent [19]

Franzke et al.

[11] Patent Number: 5,742,012

[45] Date of Patent: Apr. 21, 1998

[54] SWITCHING FIELD

[75] Inventors: Jörg Franzke; Wolfgang Kraft, both of Berlin, Germany

[73] Assignee: Krone Aktiengesellschaft, Berlin-Zehlendorf, Germany

[21] Appl. No.: 707,131

[22] Filed: Sep. 3, 1996

[30] Foreign Application Priority Data

Aug. 16, 1995 [DE] Germany ..... 195 29 974.4

[51] Int. Cl.[6] ..... H01H 13/70

[52] U.S. Cl. ..... 200/5 A; 335/234

[58] Field of Search ..... 200/5 A; 335/234; 340/825.89

[56] References Cited

U.S. PATENT DOCUMENTS 5,121,091 6/1992 Fujiyama ..... 335/1
5,557,079 9/1996 Jackson et al. ..... 200/5 A
5,561,278 10/1996 Rutten ..... 200/5 A
5,616,897 4/1997 Weber et al. ..... 200/5 A

FOREIGN PATENT DOCUMENTS

WO 92/22919 12/1992 WIPO .

*Primary Examiner*—Stuart N. Hecker
*Attorney, Agent, or Firm*—McGlew and Tuttle

[57] ABSTRACT

A switching field for electromechanically switching electrical signal lines with crosspoints. The parts forming the crosspoints comprising membranes, at and between which further parts of the circuit are disposed. The switching field is particularly for communication and data transfer applications. The cross points are disposed matrix-shaped manner and signal lines assigned to the individual crosspoints. The crosspoints are composed of at least two contact surfaces which are movable relative to each other, to the one contact surface, a permanent magnet, and to the other contact surface, a ferromagnetic material with a coil assigned thereto.

19 Claims, 1 Drawing Sheet

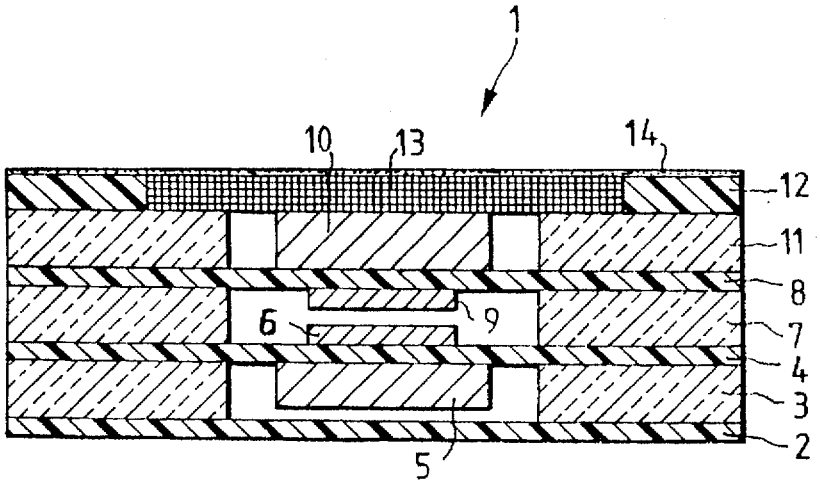
1
10
13
14
12
11
8
9
6
7
4
3
2
5

SWITCHING FIELD

FIELD OF THE INVENTION

The present invention relates to a switching field for switching electrical signal lines.

BACKGROUND OF THE INVENTION

Switching fields are preferably used in communication and data transfer applications, when a large number of lines are to be switched.

Generally electronic switching fields are employed that are designed in a space-saving manner as integrated circuits. These have the disadvantage, however, that they are only able to switch specific kinds of signals. Furthermore, electronic switching fields are sensitive to electromagnetic interferences (EMC) and large temperature variations. Switching fields not bound to a specific kind of signals are based on electrodynamic, thermal or electrostatic properties. They have very complex configurations causing high manufacturing costs. Similar considerations apply to micromechanical switching fields.

Another kind of such signal-bound switching fields is the well known electromechanical switching fields. They are composed of individual relays being combined by a corresponding wiring by means of wires or printed-circuit boards so to form switching fields. This type of configuration of the switching fields causes problems in particular for a large number of crosspoints, since these have to be arranged in different planes. For this purpose, large numbers of connection cables and various control modules must be employed.

Further, with not self-holding relays, current must continuously flow through the relay coil, in order to keep the contact closed. This leads to an undesired high power consumption, particularly since in many applications the individual crosspoints are only rarely switched.

From WO 92/22919 there is known in the art such a three-dimensional galvanic switch wherein ball-shaped connection means are moved on three positioning axes. The ball-shaped connection means are alternately designed as conductive or isolating, respectively, so that the respective crosspoint is either closed or opened. This prior art switching field permits a compact, selfholding construction of the switching fields. Disadvantageous, in this design, is the complex and costly mechanical portion.

SUMMARY AND OBJECTS OF THE INVENTION

It is therefore the primary object of the invention to provide a robust, signal-independent switching field to be manufactured in an economic and compact manner.

According to the invention, a switching field is provided for electromechanically switching electrical signal lines with crosspoints. The parts forming the crosspoints comprise membranes, at and between which further parts of the circuit are disposed.

The invention also provides a switching field for switching electrical signal lines, in particular communication and data transfer applications, comprising crosspoints disposed in a matrix-shaped manner and signal lines assigned to the individual crosspoints. The crosspoints are composed of at least two contact surfaces which are movable relative to each other, to the one contact surface, a permanent magnet, and to the other contact surface, a ferromagnetic material with a coil assigned thereto.

By assigning a permanent magnet to the one contact surface and assigning a coil having a ferromagnetic material to the opposite contact surface of each crosspoint, a particularly simple and robust design of the switching field is achieved. By selectively exciting the coil of a crosspoint the assigned ferromagnetic material is magnetized. With suitable polarity of the excitation, a magnetic attraction force between permanent magnet and ferromagnetic material and thus between the opposed contact surfaces will result. Thereby the crosspoint is dosed. This condition is maintained even after switching the excitation of the coil off. By changing the polarity of the excitation the crosspoint can be re-opened.

The mechanically flexible membrane serves as a base. Onto this base there is preferably applied a mechanically stable membrane which is opened in the area of the crosspoints is applied. At the lower the permanent magnets are attached, and at the upper side the contact surfaces are provided in the area of the crosspoints. Onto the mechanically flexible membrane there is preferably applied a mechanically stable membrane which is opened in the area of the crosspoints. Onto the mechanically stable membrane a mechanically flexible membrane is preferably applied, at the lower side of which the opposed contact surfaces are attached, and at the upper side of which the ferromagnetic material is provided in the area of the crosspoints. Onto the mechanically flexible membrane there is preferably applied a mechanically stable membrane which is opened in the area of the crosspoints, onto which a membrane carrying coils disposed in the area of the crosspoints is applied.

The mechanically flexible membrane serving as a base preferably has applied thereto the permanent magnets which are attached as a contact surface on the upper side in the area of the crosspoints. A mechanically stable membrane, opened in the area of the crosspoints is preferably applied to the mechanically flexible membrane. The opposed contact surfaces are attached onto the mechanically flexible membrane, applied at the lower side, and at the upper side of which the ferromagnetic material is provided in the area of the crosspoints. A mechanically stable membrane, opened in the area of the crosspoints is preferably applied onto the mechanically flexible membrane. Carrying coils disposed in the area of the crosspoints are preferably applied onto a membrane on the mechanically stable membrane.

The individual membranes may be glued to each other. The individual membranes may be laminated. The coils may be embedded in the membrane. The coils may also be etched in the membrane. The electrical signal lines of the contact surfaces are preferably configured as circuit tracks on the membranes towards the edges of the switching field. The leads to the coils are configured in a matrix-shaped manner towards the edges of the switching field. The switching field is preferably applied as a signal-independent, remote-controlled distributor for communication and data transfer applications.

In particular by designing the switching field by means of membranes, a specially compact construction of the switching fields is possible. Further, the design by means of membranes permits a cost effective manufacture of the switching fields, since the correspondingly prepared membranes can be further processed, and a high throughput is achievable.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only FIGURE is a sectional view of the switching field according to the invention.

DESCRIPTION OF THE PREFERRED EMBODIMENTS

Referring to the drawings in particular, the switching field of the invention comprises a multitude of crosspoints 1 preferably arranged in a matrix-shaped configuration. A mechanically flexible membrane 2 preferably serves as a base of the switching field. Onto the mechanically flexible membrane 2 there is applied a mechanically stable membrane 3. The two membranes 2, 3 can be glued to each other or later laminated with the other membranes. The mechanically stable membrane 3 is opened (has an opening) in the area of the crosspoints 1. This can be achieved for example by punching or other methods known in the membrane technology. Onto the mechanically stable membrane 3 there is applied a mechanically flexible membrane 4, on the lower side of which permanent magnets 5 are attached in the area of the crosspoints 1, and on the upper side of which are provided contact surfaces 6. Attachment of the permanent magnets 5 and of the contact surfaces 6 is preferably achieved by gluing to the mechanically flexible membrane 4. The dimensions of the permanent magnet 5 are slightly smaller than the empty spaces generated by the opening of the mechanically stable membrane 3. Onto the mechanically flexible membrane 4 there is applied a mechanically stable membrane 7 which has an opening in the area of the crosspoints 1. The mechanically stable membrane 7 is basically constructed in the same way as the mechanically stable membrane 3. On the mechanically stable membrane 7 there is applied a mechanically flexible membrane 8, on the lower side of which contact surfaces 9 are attached in the area of the crosspoints, and on the upper side of which is provided a ferromagnetic material 10. Attachment of the contact surfaces 9 and of the ferromagnetic material is preferably achieved by gluing. The contact surfaces 6, 9 are of identical shape, and it is possible to have several contact surfaces 6, 9 instead of one only. Onto the mechanically flexible membrane 8 there is applied a mechanically stable membrane 11 which has an opening in the area of the crosspoints 1. The mechanically stable membrane 11 is basically of the same construction as the mechanically stable membranes 3, 7 described above. The height dimension of the ferromagnetic material can be smaller than or identical to the height dimension of the mechanically stable membrane 11. Onto the mechanically stable membrane 11 there is applied a preferably mechanically stable membrane 12. In the membrane 12 there are embedded or etched coils 13 in the area of the crosspoints 1. The electrical leads 14 of the coils 13 are disposed on the membrane 12 preferably in a matrix-shaped manner towards the edges of the switching field.

In the following the function of the switching field will be explained.

When the coil 13 of a crosspoint 1 is excited with suitable polarity, a magnetic field magnetizing the ferromagnetic material 10 is generated. Thereby a magnetic attraction force between the permanent magnet and the ferromagnetic material 10 will result. By this force the mechanically flexible membranes 4, 8 are bent up so far that the contact surfaces 6, 9 contact each other and switch the crosspoint on. When the excitation of the coil 13 is interrupted, the ferromagnetic material 10 remains in its magnetized condition, and the crosspoint 1 remains switched on. If the contact is to be interrupted, the coil 13 is excited in reversed polarity. The electrical signal lines being connected or interrupted, respectively, by the contact surfaces 6, 9, are preferably configured as circuit tracks on the mechanically flexible membranes 4, 8 towards the edges of the switching field. The distances between the individual crosspoints 1 have to be selected sufficiently large, in order that on one hand magnetic influences are prevented and on the other hand the mechanically flexible membranes 4, 8 are sufficiently clamped down in the area of the crosspoint 1, so that by the curvature of the membranes 4, 8 at a crosspoint 1 the surrounding crosspoints 1 are not affected. In principle it is also possible to use the permanent magnet 5 as a contact surface 6 or to arrange the permanent magnet 5 immediately underneath the contact surface 6. Thereby the compactness of the switching field can additionally be increased. As indicated above, the individual membranes can be glued to each other or laminated. By the fabrication by means of membranes, for example processed from a roll, a particularly economic manufacture with high throughput is possible. A preferred field of application of the switching field is the use as a signal-independent, remote-controlled distributor for communication and data transfer applications.

We claim:

1. A switching field for electromechanically switching electrical signal lines with crosspoints, comprising:

membranes defining the crosspoints; and circuit means disposed between said membranes wherein said membranes include:

a mechanically flexible membrane serving as a base;

a mechanically stable membrane with an opening in an area of said crosspoints, said mechanically stable membrane being applied to said mechanically flexible membrane;

another flexible membrane applied to said mechanically stable membrane, said another flexible membrane having a lower side to which a permanent magnet is attached and having an upper side to which one of one of two contact surfaces is attached;

another mechanically stable membrane with an opening in the area of said crosspoints, said another mechanically stable membrane being applied to said another flexible membrane;

a further mechanically flexible membrane applied to said another mechanically stable membrane, said further mechanically flexible membrane having a lower side with an opposed contact surface of said two contact surfaces attached, and having an upper side to which a ferromagnetic material is provided;

a further mechanically stable membrane with an opening in the area of the crosspoints, said further mechanically stable membrane being disposed on said further mechanically flexible membrane: and an additional membrane carrying coils disposed in the area of the crosspoints, said additional membrane being applied on said further mechanically stable membrane.

2. A switching field for electromechanically switching electrical signal lines with crosspoints, comprising:

membranes defining the crosspoints; and circuit means disposed between said membranes, wherein said membranes include:

a mechanically flexible membrane serving as a base, said mechanically flexible membrane having a lower side to which a permanent magnet is attached and having an upper side to which one of two contact surfaces is attached;

a mechanically stable membrane with an opening in an area of said crosspoints, said mechanically stable membrane being applied to said mechanically flexible membrane;

a further mechanically flexible membrane applied to said mechanically stable membrane, said further mechanically flexible membrane having a lower side with an opposed contact surface of said two contact surfaces attached, and having an upper side to which a ferromagnetic material is provided;

a further mechanically stable membrane with an opening in the area of the crosspoints, said further mechanically stable membrane being disposed on said further mechanically flexible membrane; and an additional membrane carrying coils disposed in the area of the crosspoints, said additional membrane being applied on said further mechanically stable membrane.

3. A switching field according to claim 2, wherein said individual membranes are glued to each other.

4. A switching field according to claim 2, wherein the individual membranes are laminated.

5. A switching field according to claim 2, wherein the coils are embedded in the membrane.

6. A switching field according to claim 2, wherein the coils are etched in the membrane.

7. A switching field according to claim 2, wherein electrical signal lines of the contact surfaces are configured as circuit tracks on the membranes towards the edges of the switching field.

8. A switching field according to claim 2, wherein leads to the coils are configured in a matrix-shaped manner towards the edges of the switching field.

9. A switching field for switching electrical signal lines for communication and data transfer applications, comprising:

crosspoints disposed in a matrix, said crosspoints including two contact surfaces, said contact surfaces being movable relative to each other;

a permanent magnet connected with one of said contact surfaces; and a ferromagnetic material with a coil connected with another of said contact surfaces.

10. A switching field according to claim 9, further comprising:

a mechanically flexible membrane serving as a base, said mechanically flexible membrane having a lower side to which said permanent magnet is attached and having an upper side to which one of said contact surfaces is attached;

a mechanically stable membrane with an opening in an area of said crosspoints, said mechanically stable membrane being applied to said mechanically flexible membrane;

a further mechanically flexible membrane applied to said mechanically stable membrane, said further mechanically flexible membrane having a lower side with an opposed contact surface of said contact surfaces attached, and having an upper side to which said ferromagnetic material is provided;

a further mechanically stable membrane with an opening in the area of the crosspoints, said further mechanically stable membrane being disposed on said further mechanically flexible membrane; and an additional membrane carrying said coils disposed in the area of the crosspoints, said additional membrane being applied on said further mechanically stable membrane.

11. A switching field according to claim 9, further comprising:

a flexible membrane with a lower side with an attached one of said contact surfaces, and having an upper side to which said ferromagnetic material is provided; and another flexible membrane with a lower side to which said permanent magnet is attached and having an upper side with an attached one of said contact surfaces.

12. A switching field according to claim 9, further comprising: signal lines assigned to the individual crosspoints.

13. A switching field according to claim 9, further comprising:

a mechanically flexible membrane serving as a base;

a mechanically stable membrane with an opening in an area of said crosspoints, said mechanically stable membrane being applied to said mechanically flexible membrane;

another flexible membrane applied to said mechanically stable membrane, said another flexible membrane having a lower side to which said permanent magnet is attached and having an upper side to which one of said contact surfaces is attached;

another mechanically stable membrane with an opening in the area of said crosspoints, said another mechanically stable membrane being applied to said another flexible membrane;

a further mechanically flexible membrane applied to said another mechanically stable membrane, said further mechanically flexible membrane having a lower side with an opposed contact surface of said contact surfaces attached, and having an upper side to which said ferromagnetic material is provided;

a further mechanically stable membrane with an opening in the area of the crosspoints, said further mechanically stable membrane being disposed on said further mechanically flexible membrane; and an additional membrane carrying said coils disposed in the area of the crosspoints, said additional membrane being applied on said further mechanically stable membrane.

14. A switching field according to claim 13, wherein said individual membranes are glued to each other.

15. A switching field according to claim 13, wherein the individual membranes are laminated.

16. A switching field according to claim 13, wherein the coils are embedded in the membrane.

17. A switching field according to claim 13, wherein the coils are etched in the membrane.

18. A switching field according to claim 13, wherein electrical signal lines of said contact surfaces are configured as circuit tracks on the membranes towards the edges of the switching field.

19. A switching field according to claim 13, wherein the leads to the coils are configured in a matrix-shaped manner towards the edges of the switching field.

* * * * *